US009445483B2

(12) United States Patent
Louh et al.

(10) Patent No.: US 9,445,483 B2
(45) Date of Patent: Sep. 13, 2016

(54) LIGHTING DEVICE AND LUMINAIRE COMPRISING AN INTEGRATED ANTENNA

(71) Applicant: KONINKLIJKE PHILIPS N.V., Eindhoven (NL)

(72) Inventors: Yacouba Louh, Eindhoven (NL); Roger Henri Denker, Eindhoven (NL); Marcel De Jong, Eindhoven (NL); Nico Van Dijk, Eindhoven (NL); Jaco Van Der Merwe, Riethoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/906,337

(22) PCT Filed: Jul. 3, 2014

(86) PCT No.: PCT/EP2014/064141

§ 371 (c)(1),
(2) Date: Jan. 20, 2016

(87) PCT Pub. No.: WO2015/014564

PCT Pub. Date: Feb. 5, 2015

(65) Prior Publication Data

US 2016/0183353 A1 Jun. 23, 2016

(30) Foreign Application Priority Data

Jul. 30, 2013 (EP) ..... 13178449

(51) Int. Cl.
*H05B 37/02* (2006.01)
*H01Q 15/20* (2006.01)
(Continued)

(52) U.S. Cl.
CPC ..... *H05B 37/0272* (2013.01); *F21K 9/13* (2013.01); *F21V 23/045* (2013.01); *F21V 29/70* (2015.01); *H01Q 1/243* (2013.01); *H01Q 9/26* (2013.01); *H01Q 9/42* (2013.01); *F21Y 2101/02* (2013.01)

(58) Field of Classification Search
CPC .... F21V 23/045; F21V 29/70; F21V 23/005; H05B 37/0272; H05B 33/0842; F21Y 2103/022; F21Y 9/13; H01Q 9/42; H01Q 1/243; H01Q 1/36; H01Q 9/26
See application file for complete search history.

(56) References Cited

U.S. PATENT DOCUMENTS 4,307,403 A * 12/1981 Yamada ..... H01Q 15/22 343/755
7,301,508 B1 * 11/2007 O'Loughlin ..... H01Q 3/46 343/912

(Continued)

FOREIGN PATENT DOCUMENTS

GB 2483113 A 2/2012
JP 2011228130 A 11/2011

(Continued)

*Primary Examiner* — Vibol Tan

(57) ABSTRACT

The invention provides a lighting device (100) and a luminaire (200). The lighting device comprises a light emitter (110) thermally connected to a heat sink (120). The lighting device further comprises a communication circuit (130) which is coupled to the heat sink for transmitting and/or receiving a communication signal. The heat sink is electrically conductive and comprising an opening (151) having dimensions for constituting an aperture antenna (150) for a particular frequency for directionally transmitting and/or receiving the communication signal of the particular frequency via the heat sink. In the embodiment shown, the lighting device comprises an aperture antenna (150) and a further aperture antenna (160).

13 Claims, 5 Drawing Sheets

(51) Int. Cl.

| | |
|---|---|
| ***F21K 99/00*** | (2016.01) |
| ***F21V 23/04*** | (2006.01) |
| ***F21V 29/70*** | (2015.01) |
| ***H01Q 1/24*** | (2006.01) |
| ***H01Q 9/26*** | (2006.01) |
| ***H01Q 9/42*** | (2006.01) |
| *F21Y 101/02* | (2006.01) |

(56) References Cited

U.S. PATENT DOCUMENTS

| | | | | |
|---|---|---|---|---|
| 8,633,646 | B2 * | 1/2014 | Molezion | H01Q 1/007 315/307 |
| 9,184,497 | B2 * | 11/2015 | Chen | H01Q 1/38 |
| 2012/0274208 | A1 | 11/2012 | Chen et al. | |
| 2012/0293652 | A1 | 11/2012 | Farmer | |
| 2012/0300453 | A1 | 11/2012 | Zhou et al. | |
| 2014/0300293 | A1 * | 10/2014 | Ruan | H05B 33/0842 315/294 |
| 2015/0109781 | A1 * | 4/2015 | Van Der Merwe | F21V 23/0435 362/249.01 |
| 2016/0072176 | A1 * | 3/2016 | Van Dijk | H01Q 1/44 343/721 |

FOREIGN PATENT DOCUMENTS

| | | | |
|---|---|---|---|
| WO | 2007108019 | A1 | 9/2007 |
| WO | 2012150589 | A1 | 11/2012 |
| WO | 2013042009 | A1 | 3/2013 |

* cited by examiner

LIGHTING DEVICE AND LUMINAIRE COMPRISING AN INTEGRATED ANTENNA

CROSS-REFERENCE TO PRIOR APPLICATIONS

This application is the U.S. National Phase application under 35 U.S.C. §371 of International Application No. PCT/EP2014/064141, filed on Jul. 3, 2014, which claims the benefit of European Patent Application No. 13178449.8, filed on Jul. 30, 2013. These applications are hereby incorporated by reference herein.

FIELD OF THE INVENTION

The invention relates to lighting device comprising an integrated antenna. The invention further relates to a luminaire comprising the lighting device.

BACKGROUND OF THE INVENTION

Tele-management of light sources both for indoor and outdoor applications are increasingly popular. Intelligent lighting has become widespread, and RF communication is a powerful technology to be used in this tele-management of lamps, in particular for domestic and office environments. Instead of controlling the power supply to the lamp, the trend has moved towards directly controlling the light source or lighting device (for example an exchangeable element of the lamp) by sending an RF control signal to the lighting device.

One example of such light source comprising a communication circuit can be found in the published patent application US 2012/0274208A1 which relates to a lighting device such as a replacement lighting device, comprising a light source (e.g. LED) for producing light. The lighting device further comprises a heat sink made of a material with an electrical resistivity being less than 0.01 Ωm (e.g. a metallic heat sink) which is part of the housing and transports heat away from the light source. A radio frequency communication circuit connected to an antenna serves to enable RF signal communication (e.g. to control the device via a remote control). The antenna is arranged at least 2 mm outside the heat sink.

A problem of this lighting device is that the communication efficiency of the arrangement in the known light source is not optimal.

SUMMARY OF THE INVENTION

It is an object of the invention to provide a lighting device having a communication circuit connected to an antenna in which the communication efficiency is improved.

A first aspect of the invention provides a lighting device. A second aspect of the invention provides a luminaire. Advantageous embodiments are defined in the dependent claims.

A lighting device in accordance with the first aspect of the invention comprises a light emitter thermally connected to a heat sink. The lighting device further comprises a communication circuit coupled to the heat sink for transmitting and/or receiving a communication signal. The heat sink is electrically conductive and comprises an opening having dimensions for constituting an aperture antenna for a particular frequency for directionally transmitting and/or receiving the communication signal of the particular frequency via the heat sink. Antennas emit (and receive) the communication signal in a radiation profile which often is an omni-directional radiation profile to allow communication in a broad range around the antenna. A dipole antenna is an example of an antenna which is often used in lighting device and which has such an omni-directional radiation profile-actually a substantial donut-shaped radiation profile around the dipole antenna. Because the heat sink is electrically conductive and because the lighting devices according to the invention are often used in enclosed environments, for example, in ceilings of buildings or in luminaires, much of the omni-directional communication signal may be shielded by the heat sink or other surrounding elements which significantly reduces the communication efficiency. An aperture antenna has a completely different radiation profile compared to, for example, the dipole antenna mentioned above. The lighting device according to the invention comprises the aperture antenna and the use of the aperture antenna ensures that the efficiency of the communication may be increased significantly. In contrast to many other types of antennas, aperture antennas have a directional radiation characteristic in which most of the communication signal is directed away from the aperture. This directional radiation characteristic may be used by a designer of the lighting device to direct the communication signal away from the heat sink and away from any other surrounding and obstructing elements, which reduces the loss of communication signal and thus improves the efficiency of the communication.

As mentioned above already, lighting devices according to the invention are often enclosed by some kind of housing, for example, in a luminaire. Such housing may, next to shielding part of the communication signal, also limit the flow of air passing the heat sink and thus limit the heat flow from the heat sink to the environment. An important flow of heat from the heat sink to the environment in the housing is immediately at a light-emission opening of the housing from which the light is emitted by the lighting device. In the known lighting device the heat sink is arranged at least 2 mm away from the extending antenna, thus located away from the light-emission opening of the housing, which may reduce the heat flow from the heat sink to the environment via the light-emission opening. In the lighting device according to the invention the antenna is an aperture antenna which basically comprises an opening having predefined dimensions in the heat sink. Such an arrangement enables the heat sink to extend close to the light-emission opening of the housing or luminaire and as such enables relatively good heat flow from the heat sink via the light-emission opening into the environment. So next to having a directional radiation profile of the aperture antenna in the lighting device according to the invention, this lighting device also may improve the efficiency of the heat sink in the lighting device thus allowing an increase in light emission power of the lighting device according to the invention.

Published UK patent application GB2483113 discloses that the lighting device may comprise a circuitry which includes communications circuitry for communicating with a remote device. This published patent application further discloses that the heat sink is arranged to act as an antenna for the communications circuitry. However, nowhere in this published patent application is disclosed how the heat sink should be configured such that it acts as the antenna for the communications circuitry. In the lighting device according to the invention, the heat sink comprises an opening which has a dimension for constituting an aperture antenna.

WO2012150589A1 discloses an antenna combined with lighting device. the antenna 606 is enclosed in the housing 604. The housing 604 has an opening to allow the signal emitted by the antenna 606 out of the housing 604. However, the antenna 606 itself emits radiation within the hemisphere 616 (lines 10 to 14, page 14). This antenna 606 does not excite the housing 604 to re-emit radiation.

US 2012/0293652 discloses a LED module with integrated thermal spreader. The antenna 114 is placed within the heat spreader 104. However, it does not express that the antenna excite the heat spreader 104 to re-emit radiation. US 2012/0300453 discloses a LED light bulb. The hollow light diverting component 70 can act as a signal transceiver. However, this hollow component 70 is fabricated from a dielectric, such as a ceramic material (paragraph 0032). Thus, it can be understood by those skilled in the art that its function is only to guide the radiation. The dielectric component 70 can not be excited by the primary antenna to generate electronic filed so as to emit improved radiation by itself.

By contrast, in an embodiment of the lighting device according to the invention, the communication circuit is connected to a primary radiator at least partially surrounded by the heat sink and transmitting and/or receiving the communication signal at the particular frequency for inducing an electrical field representing the communication signal into the aperture antenna. When the dimensions of the opening in the heat sink are designed such that the opening acts as an aperture antenna for the particular frequency, any signal of the primary frequency emitted near the opening by the primary radiator will induce the electrical field inside the opening. Such electrical field across the opening causes the opening to re-emit the communication signal directionally according to the radiation characteristic of the aperture antenna. The primary radiator may, for example, be an antenna arranged inside the heat sink, or may, for example, comprise a feed-line which feeds the signal directly into the opening of the aperture antenna. Such a feed-line may, for example, be a micro-strip line or a waveguide. In the embodiment in which the primary radiator is an antenna, the primary radiator may, for example, comprise relatively high fringing fields. The fringing field of the primary radiator is a leakage field which spreads into the dielectric material surrounding the primary radiator. A benefit when using a primary radiator having a relatively high fringing field is that the excitation of the aperture can be realized indirectly through proximity coupling. The primary radiator may, for example, be a dipole antenna electrically connected to the communication circuit and located inside the heat sink near the opening. When this dipole antenna emits the communication signal of the particular frequency, the electrical field will be induced in the opening which will subsequently act as the aperture antenna and re-emit the communication signal away from the opening and away from the lighting device according to the invention. Alternatively, the primary radiator may be a Planar Inverted Field Antenna (further also indicated as PIFA) or a patch antenna which typically are antennas having relatively high fringing fields. Even further alternatively, the primary radiator may be a micro-strip line or a waveguide. Such micro-strip or waveguide constitutes a feed line or transmission line for direct excitation of the aperture.

In the lighting device according to the invention, an outer rim of the opening of the aperture antenna has a dimension substantially equal to N*(lambda/4), N being an integer number and lambda being the wavelength of the communication signal of the particular frequency. Having an opening in the heat sink which has an outer rim having the dimension substantially equal to N*(lambda/4) ensures that the opening is sensitive for a communication signal of the particular frequency such that the electrical field can be generated inside the opening. An exact shape of the opening of the aperture antenna may determine the polarization of the emitted (and received) communication signal of the predefined frequency. The dimension of the rim of the aperture antenna may deviate somewhat from the defined dimension—so the dimension is substantially equal to N*(lambda/4). A small deviation from this exact rim dimension may be present to increase the bandwidth of the aperture antenna, making the aperture antenna sensitive for a range of communication signals. Typically wireless communication is done over so called communication bands. For example, Zigbee, which is a well-known standard for wireless communication in lighting devices, has 16 channels over which data may be transmitted ranging from 2.405 GigaHertz to 2.480 GigaHertz. A single aperture antenna preferably is able to communicate via each of these different channels and so the overall bandwidth of the aperture antenna may be broad enough to cover this frequency band. As such, the deviation from the exact N*(lambda/4) rim dimension may be chosen to cover all Zigbee channels.

In an embodiment of the lighting device, an inner surface connected to the rim of the opening in the heat sink is shaped for guiding the communication signal from the primary radiator to the aperture antenna. So the opening together with the inner surface constitutes an indentation into the heat sink. In such an embodiment, the inner surface connected to the rim is a (open-ended) waveguide which acts as the aperture antenna for the particular frequency depending on the dimensions of the opening. In an embodiment of the lighting device, a cross-section of the indentation formed by the opening and the inner surface has a same shape as the shape of the rim of the opening of the aperture antenna the cross-section being arranged substantially parallel to the opening. A depth of the indentation into the heat sink and a location of the primary oscillator inside this indentation determines in which mode the open-ended waveguide starts to oscillate and thus what the actual shape of the directional radiation profile will be of the aperture antenna.

In an embodiment of the lighting device, a cross-sectional dimension of the inner surface increases towards an outside of the heat sink for creating a horn aperture antenna. A benefit of a horn aperture antenna is that the radiation profile of such horn aperture antenna is even directionally more narrow (a cross-section of the radiation profile of a horn aperture is smaller) compared to the aperture antenna. This may further enhance the efficiency of the communication of the communication circuit of the lighting device with the surroundings. As mentioned before, when the lighting device, for example, is arranged in the ceiling of a building, the communication of the communication circuit will typically take place somewhere immediately below the lighting device. Using any omni-directional antenna for communicating with the environment would reduce the communication efficiency, as much of the generated communication signal will be shielded or will be emitted in a direction in which no receiver is to be expected. Using the horn aperture antenna further strengthens the directional characteristics of the radiation profile radiated from the lighting device according to the invention and allows radiating the communication signal in a radiation profile which is even directionally narrower compared to the aperture antenna. Depending on the overall width of the radiation profile of such horn aperture, it may even be possible to distinguish the communication of individual lighting devices in a set of lighting devices.

In an embodiment of the lighting device, the primary radiator is arranged at an edge of the aperture antenna, and the aperture antenna is configured for guiding the electrical field across the opening of the aperture antenna from the edge. So the primary radiator induces the field generated due to the radiation of the communication signal by the primary radiator at the edge of the aperture antenna which at least partially acts as a wave-guide by guiding the induced electrical field across the remainder of the opening of the aperture antenna. In an embodiment of the lighting device, the lighting device comprises a further opening coupled to the aperture antenna, the further opening having dimensions for constituting a further aperture antenna for the particular frequency, the further aperture antenna being fed by the guided electrical field of the aperture antenna. In this embodiment the lighting device comprises two coupled aperture antennas, indicated as the aperture antenna and the further aperture antenna. In this embodiment the aperture antenna is configured mainly for guiding the induced electrical field towards the further aperture antenna although the aperture antenna of course also emits some part of the communication signal as the aperture antenna is not a confined waveguide or micro-strip line. A benefit of this embodiment is that the aperture antenna may be optimized to receive the communication signal from the communication circuit. This optimization may be due to the location of the aperture antenna (for example, near to the primary radiator) or due to the overall dimensions of the opening of the aperture antenna such that the communication signal may relatively easily be induced in this aperture antenna. Subsequently, the aperture antenna guides at least a part of the induced electrical field towards the further aperture antenna, which, for example, is optimized for communicating with the environment. Again this optimization of the further aperture antenna to communicate with the environment may be due to the location of the aperture antenna and may be due to the dimensions of the opening or the radiation profile of the further aperture antenna.

In an embodiment of the lighting device, the aperture antenna comprises a substantially rectangular opening defining a plane and the further aperture antenna comprises a substantially circular opening defining a further plane, the further plane being arranged substantially perpendicular to an optical axis of the lighting device. The radiation profile of an aperture antenna has a main direction substantially perpendicular to the opening (or the further opening). In this embodiment, the further aperture antenna comprises a further opening which defines a further plane which is arranged substantially perpendicular to the optical axis of the lighting device. In such an arrangement, the main direction of the radiation profile of the further aperture antenna is substantially parallel to the optical axis—and thus the communication signal will be radiated by the further aperture antenna in substantially the same direction as the light is emitted from the lighting device. This is especially beneficial when the lighting device is included in a housing, for example, in a luminaire or in a ceiling as this will typically result in an arrangement in which the communication signal is not blocked (because typically the luminaire or housing will prevent light emitted by the lighting device from being blocked).

Optionally, the plane defined by the substantially rectangular opening is arranged substantially parallel to the optical axis of the lighting device. In such an embodiment, the opening of the aperture antenna which is mainly arranged to feed the further aperture antenna is arranged substantially perpendicular to the further opening. So the primary radiator, which may, for example, feed the aperture antenna, may be located further away from the further aperture antenna, for example, on a printed circuit board located inside the lighting device. Using this substantially rectangular aperture antenna as a waveguide for feeding the further aperture antenna allows the communication signal to be guided parallel to the optical axis to the further aperture antenna and so allows an efficient transportation of the communication signal along the outside of the heat sink towards the further aperture antenna.

In an embodiment of the lighting device, the light emitter is arranged in an indentation of the heat sink, the indentation having an indentation-rim constituting the further opening of the further aperture antenna. This indentation may, for example, be a part of a collimator of the light emitter or may simply be an indentation of the heat sink in which, for example, a Light Emitting Diode (further also indicated as LED) or an Organic Light Emitting Diode (further also indicated as OLED) or a Laser diode is arranged. Such semiconducting light emitter often does not require a collimator, but typically requires a relatively large heat sink to ensure that the temperature during operation of the semiconducting light emitter does not exceed a specific threshold. Placing the light emitter in an indentation inside the heat sink allows part of the heat sink to relatively easily exchange heat with the environment at the light emission opening of the lighting device. If, in such arrangement, the indentation-rim constitutes the further opening of the further aperture antenna, the main radiation direction of the radiation for the communication via the further aperture antenna is substantially in a same direction as the emission of light.

In an embodiment of the lighting device, the lighting device further comprises a control circuit for controlling the lighting device in response to the received communication signal. The control circuit may, for example, be configured for controlling a functioning of the lighting device selected from a list comprising: on-switching, off-switching, dimming, changing color, timing the on-switching, timing the off-switching, changing focus of the emitted light, controlling beam angle, estimating life-time, consumption of power, detecting failure, identification.

The lighting device according to the invention may also comprise an outer shape arranged to cooperate with light-mounting constructions selected from the list comprising: A19, E26, E27, Eb14, E40, B22, GU-10, GZ10, G4, GY6.35, G8.5, BA15d, B15, G53, PAR, and GU5.3.

The luminaire according to the second aspect comprises the light source according to the invention.

These and other aspects of the invention are apparent from and will be elucidated with reference to the embodiments described hereinafter.

It will be appreciated by those skilled in the art that two or more of the above-mentioned options, implementations, and/or aspects of the invention may be combined in any way deemed useful.

Modifications and variations of the color conversion arrangement, the lighting unit and the solid state light emitter package, which correspond to the described modifications and variations of the color conversion arrangement, can be carried out by a person skilled in the art on the basis of the present description.

Figure 1:
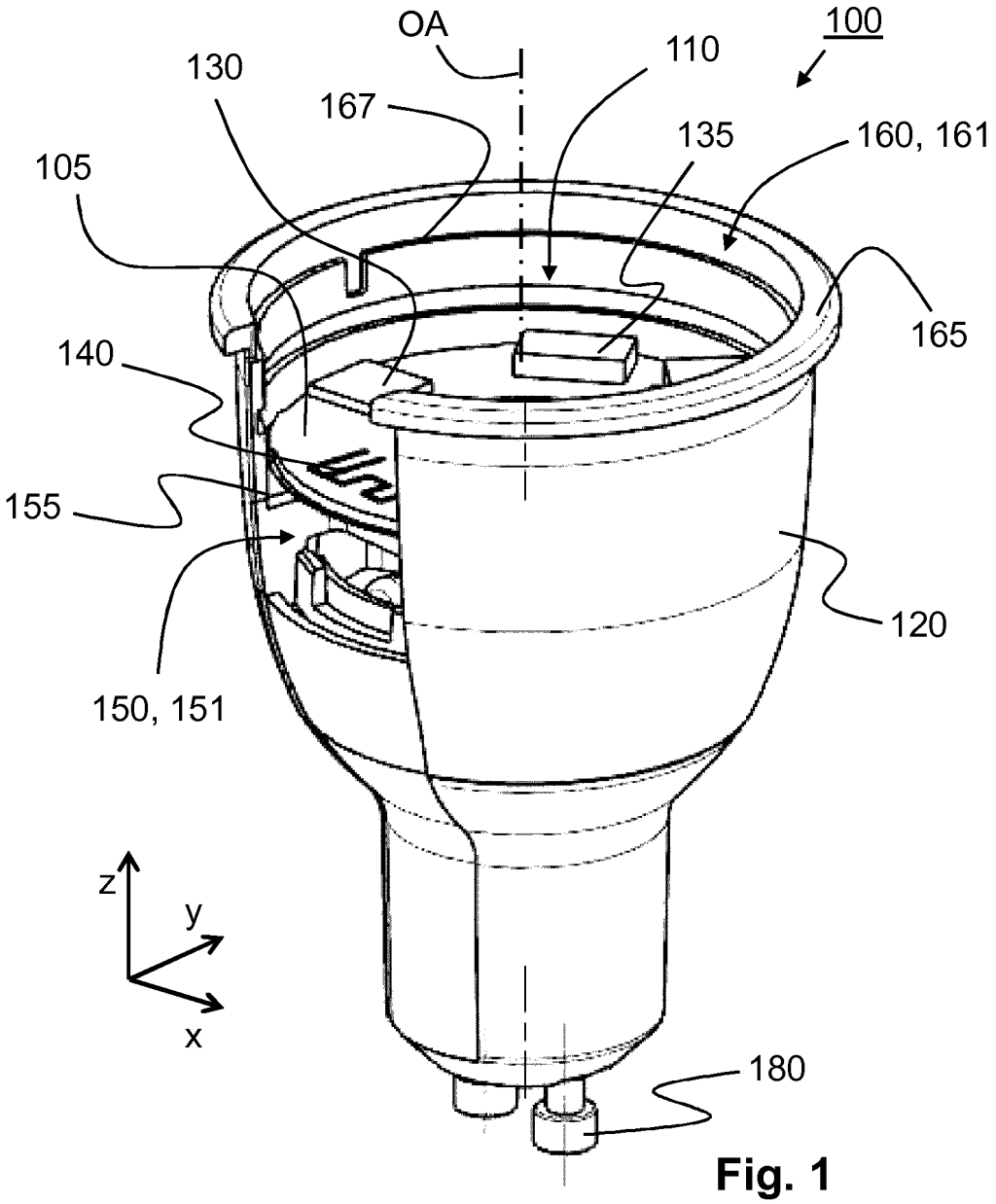
FIG. 1 shows a schematic plan-view of a first embodiment of an aperture antenna in the lighting device according to the invention.

It should be noted that items denoted by the same reference numerals in different Figures have the same structural features and the same functions, or are the same signals. Where the function and/or structure of such an item have been explained, there is no necessity for repeated explanation thereof in the detailed description.

The Figures are purely diagrammatic and not drawn to scale. Particularly for clarity, some dimensions are exaggerated strongly.

DETAILED DESCRIPTION

FIG. 1 shows a schematic plan-view of a first embodiment of an aperture antenna 150 in the lighting device 100 according to the invention. An aperture antenna 150 is an opening 151 in a conductive material in which the dimensions of the opening 151 enable the generation of an electric field E (see FIG. 2) inside the aperture 150. The generated electric field E determines the communication frequency, radiation profile and polarization of the radiation radiated from the aperture antenna 150. The embodiment shown in FIG. 1 shows the lighting device 100 comprising a light emitter 110 thermally connected to a heat sink 120. The light emitter 110 is not visible in FIG. 1, but is connected to the PCB 105 inside the heat sink 120. The light emitter 110 may be any light emitter 110, such as a LED, OLED, Laser or even a high-pressure discharge lamp. The lighting device 100 further comprises a communication circuit 130 also connected to the PCB 105 and connected to a primary radiator 140 for transmitting and/or receiving a communication signal. This primary radiator 140 is coupled to the heat sink 120 via a capacitive coupling to the aperture antenna 150 being a substantially rectangular opening 151 or aperture 151 defining a plane (not indicated) which is arranged substantially parallel to an optical axis OA of the lighting device 100. An outer rim 155 of the aperture antenna 150 is defined such that the signal radiated by the primary radiator 140 is induced into the aperture antenna 150 and creates an electrical field inside the opening 151 constituting the aperture antenna 150. The electrical field E inside the aperture antenna 150 will be guided by the aperture antenna 150 across the complete aperture antenna 150 while the aperture antenna 150 also radiates part of the induced communication signal. The aperture antenna 150 is coupled to a further opening 161 or aperture 161 constituting a further aperture antenna 160, and the aperture antenna 150 feeds this further aperture antenna 160 via the guided electrical field E inside the aperture antenna 150. Also the further aperture antenna 160 has an outer rim 165 with dimensions to allow the electrical field E to be generated inside the further aperture antenna 160 and to allow the further aperture antenna 160 to radiate the communication signal away from the lighting device 100. The further aperture antenna 160 defines a further plane (not shown) which is arranged substantially perpendicular to the optical axis OA of the lighting device 100.

As mentioned before, in contrast to many other types of antennas, aperture antennas 150, 160 have a directional radiation characteristic in which most of the communication signal is directed away from the openings 151, 161 or apertures 151, 161. This directional radiation characteristic may be used by a designer of the lighting device 100 to direct the communication signal away from the heat sink 120 and away from any other surrounding and obstructing elements, which reduces the loss of communication signal and thus improves the efficiency of the communication.

The outer rims 155, 165 of the aperture antennas 150, 160 may have substantially any shape—as long as the dimensions enable the generation of the electric field E inside the aperture antennas 150, 160. However at some point, when the shape of the outer rims 155, 165 gets close to the shape of a slot antenna (that is when the length dimensions are approximately lambda/2 and the width dimensions much smaller than lambda/2) the opening in the heat sink 120 will no longer behave as an aperture antenna 150, 160 (directional radiation of the communication signal), but will behave similar as a dipole antenna having an omni-directional emission characteristic.

The primary radiator 140 is at least partially surrounded by the heat sink 120 and is configured for transmitting and/or receiving the communication signal at the particular frequency for inducing an electrical field E representing the communication signal into the aperture antenna 150. When the dimensions of the opening 151 in the heat sink 120 are designed such that the opening 151 acts as an aperture antenna 150 for the particular frequency, any signal of the primary frequency emitted near the aperture antenna 150 (for example, by the primary radiator 140) induces the electrical field E inside the aperture antenna 150. Such electrical field E across the aperture antenna 150 causes the aperture antenna 150 to re-emit the communication signal directionally according to the radiation characteristic of the aperture antenna 150. In the embodiment shown in FIG. 1, the opening 151 or aperture antenna 150 is configured to guide the induced electrical field E—and as such guide the induced communication signal—towards the further opening 161 or further aperture antenna 160 while emitting part of the induced communication signal. So the aperture antenna 150 acts as a kind of waveguide to guide the communication signal from the primary radiator 140 to the further aperture antenna 160. However, this aperture antenna 150 is not a perfect waveguide—because the construction does not allow to confine the electrical field E in all directions—and so part of the guided communication signal will be emitted by the aperture antenna 150. The primary radiator 140 may, for example, be an antenna 140 arranged inside the heat sink 120, or may, for example, comprise a feed-line (not shown) which feeds the signal directly into the opening 151 of the aperture antenna 150. Such a feed-line may, for example, be a micro-strip line (not shown) or a waveguide (not shown). The primary radiator 140 may, for example, be a dipole antenna (not shown) electrically connected to the communication circuit 130 and located inside the heat sink 120 near the aperture. Alternatively, the primary radiator 140 may be a Planar Inverted Field Antenna (further also indicated as PIFA) 140 or a patch antenna 140 which typically are antennas having relatively high fringing fields.

In the lighting device 100 according to the invention, outer rims 155, 165 of the openings 151, 161 of the aperture antennas 150, 160 have a dimension substantially equal to N*(lambda/4), N being an integer number and lambda being the wavelength of the communication signal of the particular frequency. Having an opening in the heat sink 120 which has an outer rim 155, 165 having the dimension substantially equal to N*(lambda/4) ensures that the opening 151, 161 or aperture 151, 161 is sensitive for a communication signal of the particular frequency such that the electrical field E can be generated inside the aperture antenna 150, 160. An exact shape of the opening 151, 161 of the aperture antenna 150, 160 may determine the polarization of the emitted (and received) communication signal of the predefined frequency. As mentioned before, the dimension of the outer rim 155, 165 of the aperture antenna 150, 160 may deviate somewhat from N*(lambda/4) to increase the bandwidth of the aperture antenna 150, 160, making the aperture antenna 150, 160 sensitive for a range of communication signals. Typically wireless communication is done over so called communication bands. For example, Zigbee, which is a well-known standard for wireless communication in lighting devices 100, has 16 channels over which data may be transmitted ranging from 2.405 GigaHertz to 2.480 GigaHertz. A single aperture antenna 150, 160 preferably is able to communicate via each of these different channels and so the overall bandwidth of the aperture antenna 150, 160 may be broad enough to cover this frequency band. As such, the deviation from the exact N*(lambda/4) rim dimension may be chosen to cover all Zigbee channels.

The lighting device 100 according to the invention may have an inner surface 167 connected to the rim 165 of the opening 160 in the heat sink 120 which is shaped for guiding the communication signal from the primary radiator 140 to the aperture antenna 160.

So the opening 160 together with the inner surface 167 constitutes an indentation into the heat sink 120 to generate a kind of open-ended waveguide which acts as the aperture antenna 160 for the particular frequency. A depth of the indentation into the heat sink 120 and a location of the primary oscillator 140 inside this indentation determines in which mode the open-ended waveguide (or the aperture antenna 160) starts to oscillate and thus what the actual shape of the directional radiation profile will be of the aperture antenna 160.

The lighting device 100 as shown in FIG. 1 further comprises a control circuit 135 for controlling the lighting device 100 in response to the received communication signal. The control circuit 135 may, for example, be configured for controlling a functioning of the lighting device 100 selected from a list comprising: on-switching, off-switching, dimming, changing color, timing the on-switching, timing the off-switching, changing focus of the emitted light, controlling beam angle, estimating life-time, consumption of power, detecting failure, identification. Finally, the lighting device 100 comprises electrical connection pins 180 for connecting the lighting device 100 to a power supply. Of course such connection pins 180 may also be used as communication port via a kind of power-line control signal for further communication of the lighting device 100 to a kind of power-line network (not shown).

Figure 2:
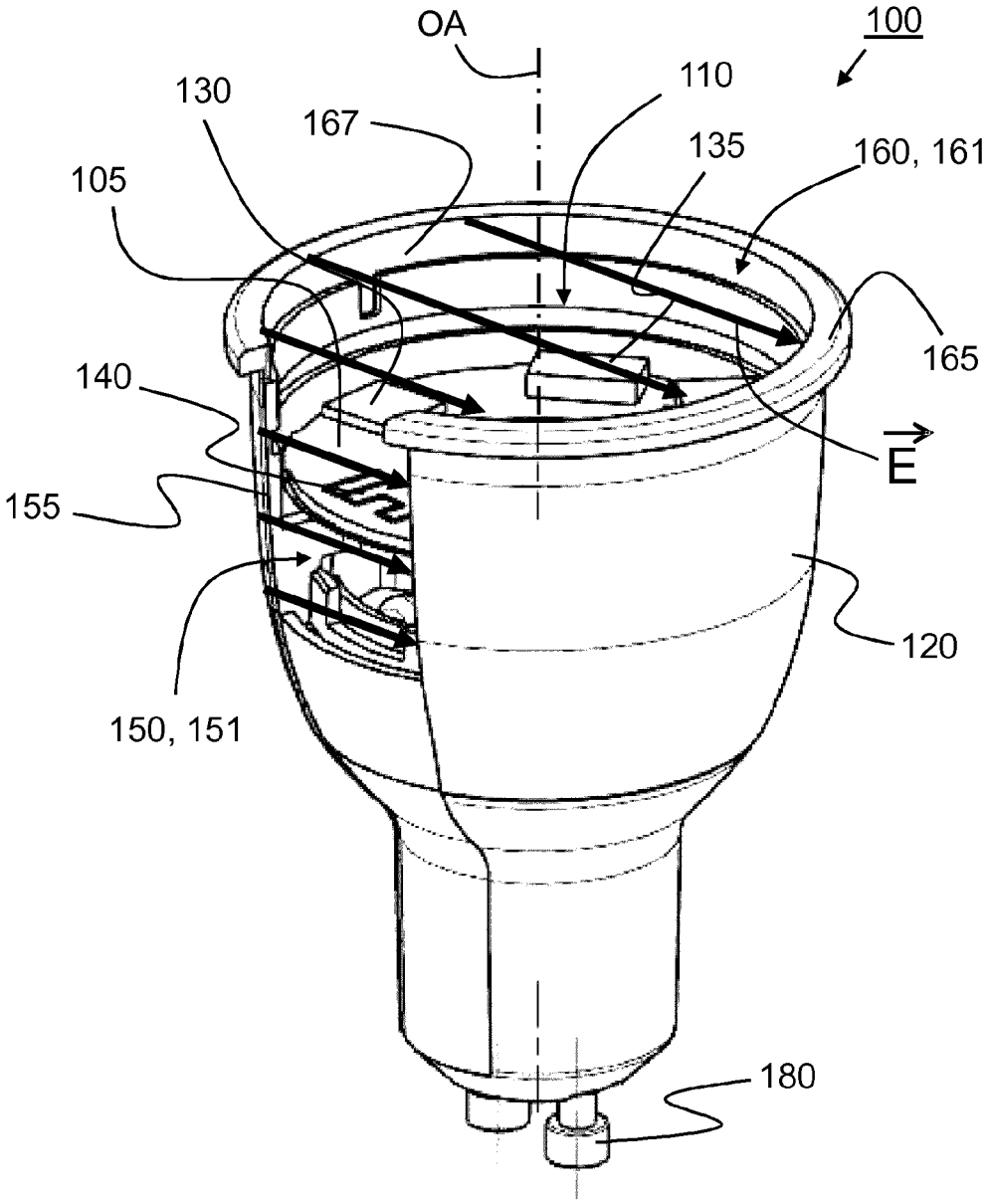
FIG. 2 shows a schematic plan-view of the first embodiment of the aperture antenna in the lighting device according to the invention in which the electric field is indicated.

FIG. 2 shows a schematic plan-view of the first embodiment of the aperture antennas 150, 160 in the lighting device 100 according to the invention in which the electric field E is indicated. As mentioned before, the dimensions of the aperture antenna 150 and the further aperture antenna 160 together with the communication signal provided by the primary radiator 140 determine the exact shape of the electrical field E generated in the aperture antenna 150 and the further aperture antenna 160. This electrical field E further determines the radiation profile and the characteristics of the radiated communication signal, including the polarization of the radiated signal.

Figure 3:
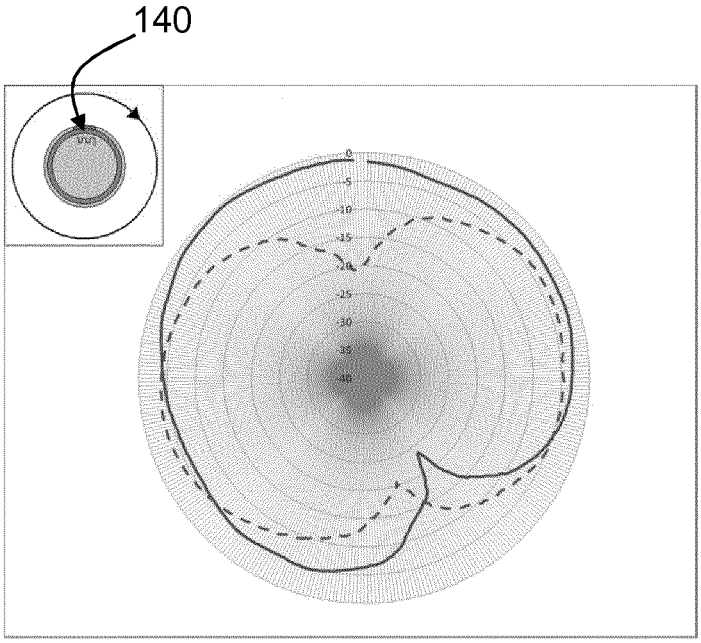
FIG. 3 shows a radiation pattern of the first embodiment of the aperture antenna according to the invention, measured in the xy plane.

FIG. 3 shows a radiation pattern of the first embodiment of the lighting device 100 according to the invention, measured in the xy plane. The solid line represents the radiation pattern of the horizontally polarized communication signal, and the dashed line represents the radiation pattern of the vertically polarized communication signal. Also indicated in the miniature at the upper left corner of FIG. 3 is the location of the primary radiator 140.

Figure 4:
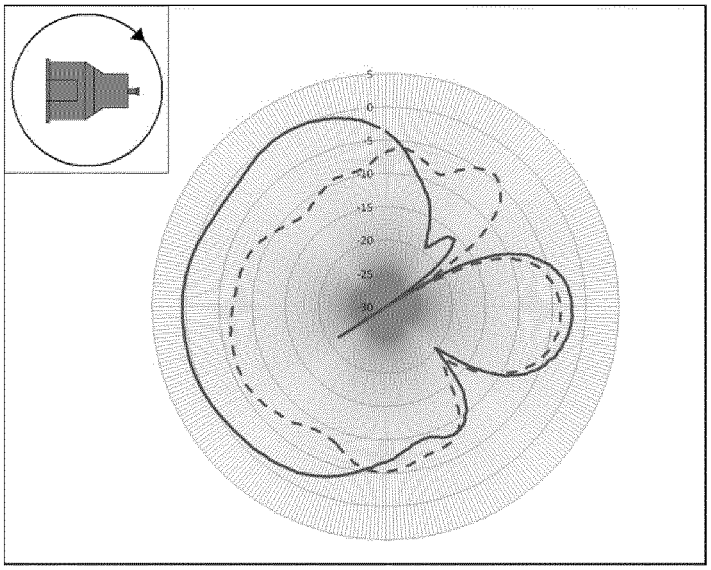
FIG. 4 shows a radiation pattern of the first embodiment of the aperture antenna according to the invention, measured in the xz plane.

FIG. 4 shows a radiation pattern of the first embodiment of the lighting device 100 according to the invention, measured in the xz plane. Again, the solid line represents the radiation pattern of the horizontally polarized communication signal, and the dashed line represents the radiation pattern of the vertically polarized communication signal. As can be clearly seen from FIG. 4, the radiation profile of the aperture antenna 150, 160 is directed mainly away from the aperture antenna 150, 160 substantially parallel to the optical axis OA (see FIG. 1).

Figure 5:
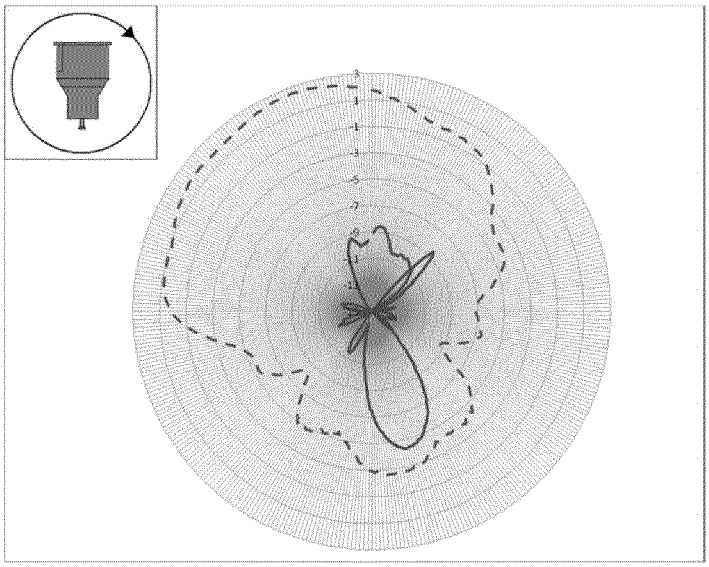
FIG. 5 shows a radiation pattern of the first embodiment of the aperture antenna according to the invention, measured in the yz plane.

FIG. 5 shows a radiation pattern of the first embodiment of the lighting device 100 according to the invention, measured in the yz plane. Again, the solid line represents the radiation pattern of the horizontally polarized communication signal, and the dashed line represents the radiation pattern of the vertically polarized communication signal. Now the horizontally polarized communication signal is significantly weaker than the vertically polarized communication signal, indicating that the aperture 150, 160 is designed to enhance this vertically polarized communication signal rather than the horizontally polarized communication signal.

Figure 6:
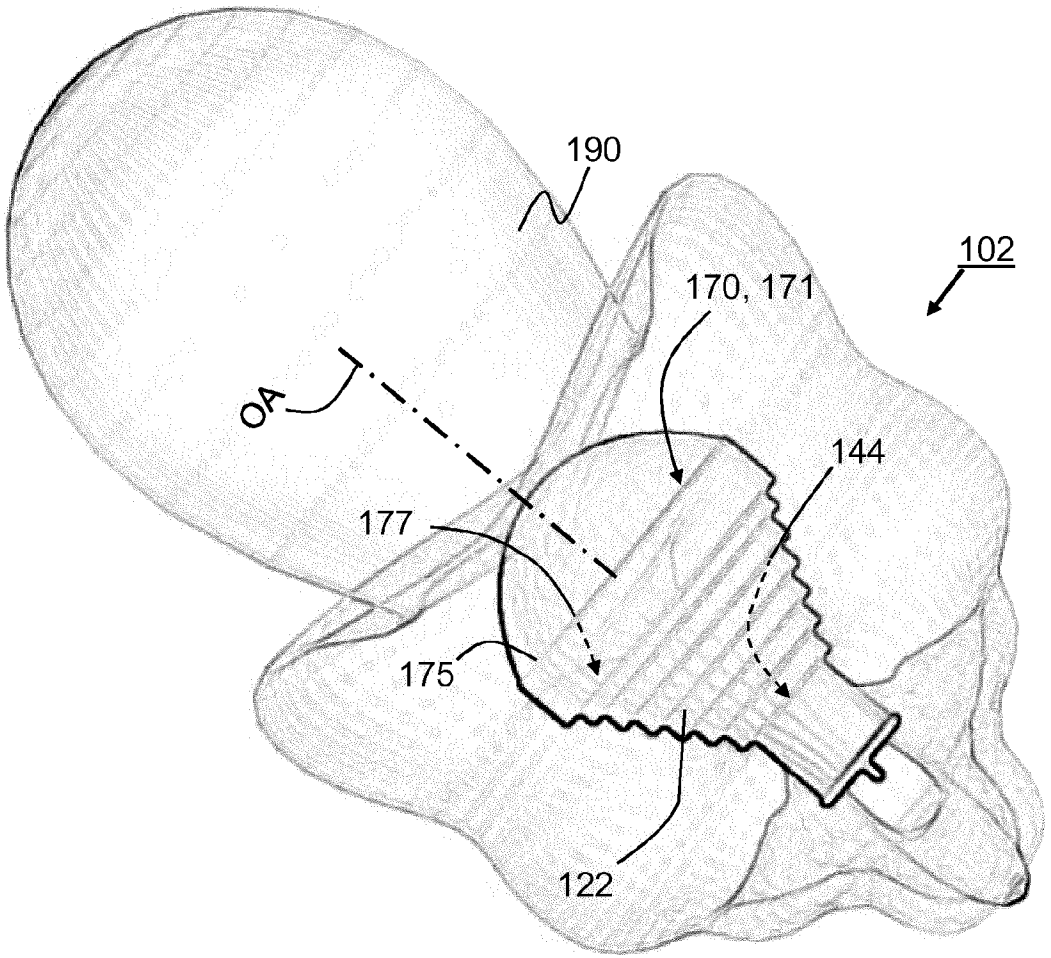
FIG. 6 shows a schematic plan-view of a second embodiment of the lighting device showing a three-dimensional radiation pattern of a conical horn aperture antenna.

FIG. 6 shows a schematic plan-view of a second embodiment of the lighting device 102 showing a three-dimensional radiation pattern of a conical horn aperture antenna 170. The heat sink 122 comprises an inner wall 177 which has a conical shape to create a conical horn aperture antenna 170. In FIG. 6, the inner wall 177 is indicated using a partially solid and partially dashed arrow, in which the dashed part illustrates part of the reference arrow which enters an opening 171 of the aperture antenna 170. The divergence of the inner dimensions toward the opening 171 or aperture 171 determines how well this horn-shape of the horn aperture antenna 170 further concentrates the directionality of the emitted communication signal. Well known design formulas may be used to define this divergence to create the required radiation distribution. The shape of the outer rim 175 of the aperture antenna 170 may have substantially any shape—as long as the dimensions enable the generation of the electric field E (see FIG. 2) inside the aperture antenna 170. As can be seen from the radiation profile 190, the directionality of such horn aperture antenna 170 is much stronger compared to the previous embodiment (FIGS. 3 to 5) which is beneficial as the lighting devices 102 are often build into a housing or surrounding (ceiling) and so mainly the radiation in a direction similar as the emission of the light would be preferred—radiation in other directions may be shielded by the surroundings or the signal emitted in another direction than the similar light emission direction is not likely to hit any receiving antenna.

Figure 7:
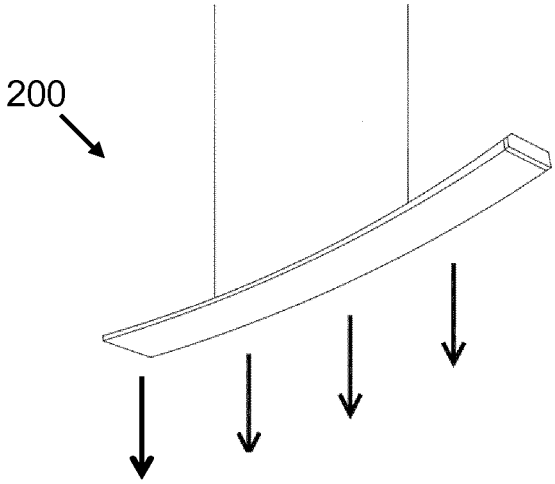
FIG. 7 shows a schematic plan-view of a luminaire according to the invention.

The primary radiator 144 for such horn aperture antenna 170 is preferably located inside the horn-shaped, for example, at a location inside the heat sink 122 where the inner wall 177 starts its step-wise diverging towards the outer rim 175. In FIG. 6, the location of the primary radiator 144 is indicated using a partially solid and partially dashed arrow, in which the dashed part illustrates part of the reference arrow which is located inside the horn-shaped opening 171 of the aperture antenna 170. Such a primary radiator 144 may be another aperture antenna or any other primary radiator 144 indicated herein above. FIG. 7 shows a schematic plan-view of a luminaire 200 according to the invention. The luminaire 200 comprises, for example, light mounting constructions which can cooperate with the outer dimensions of the lighting device 100, 102 such that the lighting device 100, 102 may be fit into the luminaire 200.

Summarized, the current application provides a lighting device 100 and a luminaire 200. The lighting device comprises a light emitter 110 thermally connected to a heat sink 120. The lighting device further comprises a communication circuit 130 which is coupled to the heat sink for transmitting and/or receiving a communication signal. The heat sink is electrically conductive and comprising an opening 151 having dimensions for constituting an aperture antenna 150 for a particular frequency for directionally transmitting and/or receiving the communication signal of the particular frequency via the heat sink. In the embodiment shown, the lighting device comprises an aperture antenna 150 and a further aperture antenna 160.

It should be noted that the above-mentioned embodiments illustrate rather than limit the invention, and that those skilled in the art will be able to design many alternative embodiments without departing from the scope of the appended claims.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A lighting device comprising:

a heat sink;

a light emitter thermally connected to the heat sink, a communication circuit being coupled to the heat sink for transmitting and/or receiving a communication signal, wherein the heat sink being electrically conductive and comprising an opening having specific dimensions for constituting an aperture antenna tuned for a particular frequency for directionally transmitting and/or receiving the communication signal of the particular frequency via the heat sink, wherein the communication circuit is connected to a primary radiator at least partially surrounded by the heat sink and transmitting and/or receiving the communication signal at the particular frequency for inducing an electrical field representing the communication signal into the aperture antenna, and the electrical field across the opening causes the opening to re-emit the communication signal directionally according to the radiation characteristic of the aperture antenna, wherein an outer rim of the opening of the aperture antenna has a dimension equal to N*(lambda/4), N being an integer number and lambda being the wavelength of the communication signal of the particular frequency.

2. The lighting device according to claim 1, wherein the primary radiator is selected from a list comprising: a dipole antenna, a Planar Inverted Field Antenna, a patch antenna, a micro-strip line and a waveguide.

3. The lighting device according to claim 1, wherein an inner surface connected to the rim of the opening in the heat sink is shaped for guiding the communication signal from the primary radiator to the aperture antenna.

4. The lighting device according to claim 3, wherein a cross-sectional dimension of the inner surface increases towards an outside of the heat sink for creating a horn aperture antenna.

5. The lighting device according to claim 1, wherein the primary radiator is arranged at an edge of the aperture antenna, and the aperture antenna is configured for guiding the electrical field across the opening of the aperture antenna from the edge.

6. The lighting device according to claim 5, wherein the lighting device comprises a further opening coupled to the aperture antenna, the further opening having dimensions for constituting a further aperture antenna for the particular frequency, the further aperture antenna being fed by the guided electrical field of the aperture antenna.

7. The lighting device according to claim 6, wherein the aperture antenna comprises a substantially rectangular opening defining a plane, and wherein the further aperture antenna comprises a substantially circular opening defining a further plane, the further plane being arranged substantially perpendicular to an optical axis (OA) of the lighting device.

8. The lighting device according to claim 7, wherein the plane defined by the substantially rectangular opening is arranged substantially parallel to the optical axis (OA) of the lighting device.

9. The lighting device according to claim 7, wherein the light emitter is arranged in an indentation of the heat sink, the indentation having an indentation-rim constituting the further opening of the further aperture antenna.

10. The lighting device according to claim 1, wherein the lighting device further comprises a control circuit for controlling the lighting device in response to the received communication signal.

11. The lighting device according to claim 10, wherein the control circuit is configured for controlling a functioning of the lighting device, the functioning of the lighting device being selected from a list comprising: on-switching, off-switching, dimming, changing color, timing the on-switching, timing the off-switching, changing focus of the emitted light, controlling beam angle, estimating life-time, consumption of power, detecting failure, and identification.

12. The lighting device according to claim 1, wherein an outer shape of the lighting device is arranged to cooperate with light-mounting constructions selected from the list comprising: A19, E26, E27, E14, E40, B22, GU-10, GZ10, G4, GY6.35, G8.5, BA15d, B15, G53, PAR, and GU5.3.

13. A luminaire comprising the lighting device according to claim 1.

* * * * *